United States Patent [19]

McAllister et al.

[11] Patent Number: 4,750,587

[45] Date of Patent: Jun. 14, 1988

[54] LADDER AND METHOD OF USING LADDER FOR ESCAPE

[75] Inventors: William A. McAllister, 28 Fernwood Dr., P.O. Box 222, Newfield, N.J. 08344; Frederick Schindler, Newfield, N.J.

[73] Assignee: William A. McAllister, Newfield, N.J.

[21] Appl. No.: 109,090

[22] Filed: Oct. 16, 1987

[51] Int. Cl.[4] ..... E06C 1/36; E06C 1/383

[52] U.S. Cl. ..... 182/161; 182/206; 182/207

[58] Field of Search ..... 182/159, 160, 161, 96, 182/108, 109, 110, 206, 207

[56] References Cited

U.S. PATENT DOCUMENTS

| | | | |
|---|---|---|---|
| 647,163 | 4/1900 | Smith . | |
| 1,371,125 | 3/1921 | Speckman | 182/160 |
| 1,570,564 | 1/1926 | Hamel | 182/110 |
| 1,579,574 | 4/1926 | Taylor | 182/159 |
| 2,120,060 | 6/1938 | Williams | 108/16 |
| 2,132,848 | 10/1938 | Feldman | 108/16 |
| 3,085,490 | 4/1963 | Field | 98/43 |
| 3,520,245 | 7/1970 | Painter | 98/42 |
| 3,557,497 | 1/1971 | Schafer | 52/1 |
| 3,839,949 | 10/1974 | Gobel | 98/42 |
| 4,190,987 | 3/1980 | Naidus | 52/1 |
| 4,197,682 | 4/1980 | Schiff et al. | 52/72 |
| 4,412,404 | 11/1983 | Manning | 52/19 |
| 4,560,030 | 12/1985 | Mucelli | 182/160 |
| 4,618,027 | 10/1986 | Piretti | 182/160 |

FOREIGN PATENT DOCUMENTS

| | | | |
|---|---|---|---|
| 2138947 | 12/1977 | Fed. Rep. of Germany . | |
| 823849 | 11/1959 | United Kingdom | 182/160 |

*Primary Examiner*—Reinaldo P. Machado
*Attorney, Agent, or Firm*—Thomas A. Lennox

[57] ABSTRACT

An escape ladder at rest is an elongated cylindrical body divided lengthwise with a plurality of rung devices hingeably attached between rear quadrants and between front quadrants lockable in a horizontal position and foldable into the tubular body when left and right quadrants and mated together. Right quadrants and left quadrants are interlocked together to allow the interlocked quadrants to slideably move only lengthwise in relation to each other.

35 Claims, 6 Drawing Sheets

20

LADDER AND METHOD OF USING LADDER FOR ESCAPE

BACKGROUND OF THE INVENTION

This invention involves a ladder that can be stored unobtrusively in the room from which escape is possible.

In many living quarters, such as row homes having two or three stories, it is a major concern that the occupants might be trapped by a fire in the upper floors. The windows, front and back typically do not offer a change of safe escape, particularly from a third floor. On the other hand, it is common to have skylights from a third floor ceiling to either a sloped roof or in many cases a flat roof which continues to the adjoining row homes. As a consequence, if the occupants can escape through a sky light to the flat roof, their safety is essentially assured as they can move in either direction away from the fire to either an exterior fire escape or to a neighboring portion of the building where they can descend through a door or skylight and attain the ground safely. The problem arises that few persons will have a rigid ladder available on the third floor of a home as storage is difficult and they are generally unsightly. A rope or chain ladder cannot be used by an elderly person and is difficult to used by anyone unless it is resting against a vertical wall. As a consequence, although a skylight that is easily opened as an escape door to the roof is an appealing addition to such homes, there has been no practical way of climbing to the skylight to escape a fire.

The ladder devices of the prior art do not satisfy these needs and do not attain the objects of the invention listed herein below.

SUMMARY OF THE INVENTION

An object of the present invention is to provide a ladder which will collapse horizontally to form a relatively small elongated housing.

It is a further object of the present invention to provide a ladder that can be stored unobtrusively in a corner appearing as a vertical rod member which can be utilized for other purposes including decoration, hanging of towels and the like.

A specific object of the present invention is to provide a ladder which can be stored unobtrusively in an upstairs interior room from which escape is possible through an aperture, such as a skylight, through the ceiling of that room.

It is a particular object of the present invention to provide a ladder which when opened is extendable to a height greater than the ceiling of the room which corresponded to the unextended length of the ladder.

It is an additional object of the present invention to provide a ladder which is extendable to a length which will interfit over the outside frame of an open skylight and extend downwardly hanging from that position at an angle to rest on the floor, the angle being satisfactory for easy climbing through the skylight.

It is a particular object of the present invention to provide a ladder which will collapse to a narrow member, but yet when opened, the rungs will fold downwardly to a horizontal position, locking in that position to provide a secure safe foot hold and locking the ladder in its open usable position.

It is a particular object of the present invention to provide a ladder which may be extruded to form the ladder side members.

It is a particular object of the present invention to provide a ladder which when collapsed downwardly to form a narrow compact body will interfit between the ceiling and floor of a room by compression of support members of the ladder.

It is a particular object of the present invention to provide a ladder which when collapsed to form a vertical support member can be utilized to support and hold other objects such as house plants, nick knacks, towels and the like.

The invention includes a ladder that can be stored as an unobtrusive and/or useful tubular shape held between floor and ceiling of a room equipped with a skylight openable to allow escape to the roof. The ladder includes a hollow elongated tubular, preferably hollow, housing divided lengthwise into two separate ladder side members and a plurality of rung devices, each device comprising a rung separated into two rung members, preferably equal in length, which together span a distance between the ladder side members. The term "tubular" includes all multifaceted tubular structures including but not limited to cross-sectional shapes having an outside surface of round (cylindrical), square, hexagonal, octagonal and the like. A cylindrical shape is preferred. The ladder further includes center hinging devices to join the two rung members to hingeably collapse upwardly and to form a rigid structural support when each rung is lowered to a horizontal position. End hinging devices are provided to connect the ends of each rung member to opposite ladder side members in a horizontal position and to allow the rung members to hingeably collapse upwardly to vertical position when the ladder side members are moved together. The tubular housing is of sufficient the size and shape to enclose the hingeably collapsed rungs when the ladder side members are mated together. A preferred embodiment includes each ladder side member being separated lengthwise into a front side member and a rear side member. This preferred ladder further includes a slide device to lengthwise abut and interlock the front side member with the rear side member while allowing them to slide lengthwise relative to each other to extend the length of the ladder. In this preferred embodiment rung devices include two separate rungs, one rung hingeably attached to the front side members and one rung hingeably attached to the rear side members. A further preferred embodiment further includes a base support member separated into two parts, one part of sufficient size and shape to receive a bottom of one ladder side member and the other part to receive the other ladder side member bottom, the base support member further including a compressing device to allow sufficient resilient compression of the support member to hold the housing wedged between the floor and the ceiling.

The base member is preferably attached to the front side member and merely engages the rear side member. The ladder further preferably includes a top support member separated into two parts, one part of a sufficient size and shape to attach to a top of one ladder side member and the other part to attach the other ladder side member top, the top support member further comprising a hook device to hang the ladder proximate an escape opening out through the ceiling. The hook device may hook over the molding outside an open skylight are onto a special mounting device to receive and hold the ladder. It is preferred that each part of the top support member is attached to the rear side member and merely engages the front side member. It is preferred that the two ladder side members be extruded and when mated together form a cylindrical shape. A preferred slide device includes a pair of parallel grooves cut lengthwise into outside surfaces of the front and rear side members proximate to and on opposite sides of an abutting mating joint between the front and rear side members, wherein the direction of the depth of the grooves are angled toward each other. The preferred slide device further includes an extruded "U" shaped rigid member shaped to interfit into the grooves and of sufficient size to allow the "U" shaped member to slide along the length of the grooves. A slide attachment device is provided to rigidly attach the "U" shaped member to either the front side member or to the rear side member. It is preferred to include handles attached to opposite "U" shaped members to allow easy opening and closing of the ladder, and that the handles be structured to serve a separate function of holding objects when the tubular housing is closed with rungs folded away. Holes are preferably provided into the housing to receive towel hanging rods or like useful devices.

DESCRIPTION OF THE PREFERRED EMBODIMENTS

Figure 1:
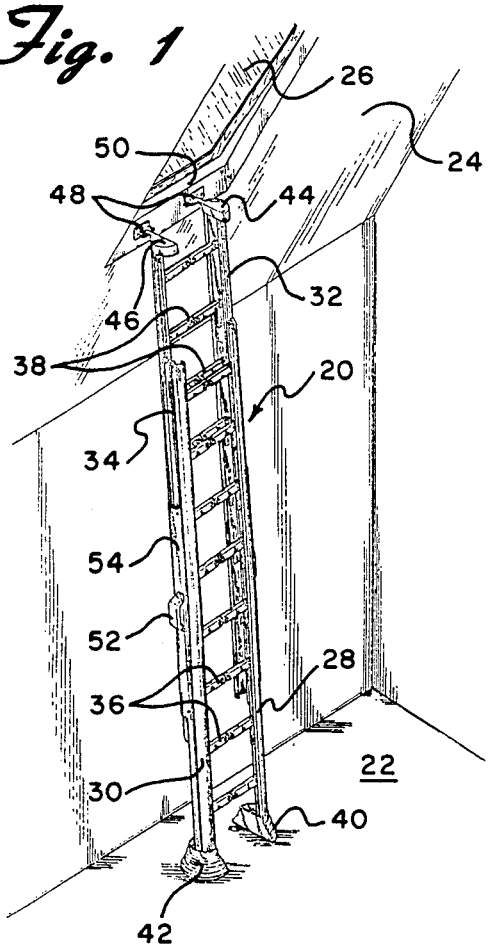
FIG. 1 is a perspective view of a ladder of this invention hung from hooks proximate a skylight allowing escape from the room.

A preferred escape ladder of the invention includes an elongated tubular housing including a length having a top and a bottom to interfit between ceiling and floor of interior rooms, and mated halves juxtaposed along lengthwise joints that form ladder side members when separated from each other. The ladder further includes a plurality of jointed rung members that hingeably attach at their ends to opposite ladder side members and hingeably fold upwardly when the ladder side members are mated together. The ladder includes an elongation device to allow the ladder side members to elongate and a hanging device to hang the top the ladder side members proximate an escape opening out through the ceiling. The preferred elongation device includes each ladder side member being separated lengthwise into a front side member and a rear side member, and a slide device to lengthwise abut and interlock each front side member with the adjacent rear side member while allowing them to slide lengthwise relative to each other to extend the length of the ladder. A preferred slide device includes dovetail joint between an abutting mating joint between front and rear side members. A preferred compressing device in the base support member includes the member being a soft resilient polymeric composition. It is preferred that the rung devices be attached between the rear side members only proximate an upper portion of the ladder.

A method of the present invention is to provide escape from an upstairs room with a ceiling escape aperture of sufficient size and shape to allow a person to escape out through the aperture. The method includes placing a ladder with a top and a bottom, the ladder being capable of collapsing horizontally into a tubular shape to interfit vertically between the ceiling and a floor of the room. The method continues removing the ladder from between the ceiling and the floor and pulling the ladder side members apart to cause rung members of the ladder to drop and lock in a horizontal position. The method continues by extending the ladder a sufficient length to reach a height proximate the aperture when the ladder is placed at an angle suitable for climbing and hanging the top of the ladder of the ladder proximate the aperture with bottom of the ladder resting on the floor. The method also include hingeably collapsing center hinging means joining jointed rung members at a rung center to collapse the rung members upwardly and be enclosed inside the tubular shape. A preferred method includes sliding separated side members, the side members being separated lengthwise into a front side member and a rear side member, interlocked between each other allowing them to slide lengthwise relative to each other to extend the length of the ladder.

A preferred ladder of the present invention includes an elongated tubular body is divided lengthwise such that a lateral cross-section of the body divided into four quadrants, the quadrants being front quadrants, right and left, and rear quadrants, right and left. The ladder includes a plurality of rung devices hingeably attached between rear quadrants and between front quadrants to provide support in a horizontal position and fold upwardly for storage inside the tubular body when the left and right quadrants and mated together. The ladder also includes interlocking devices to interlock right quadrants together and left quadrants together to allow the interlocked front and back quadrants to slideably move only lengthwise in relation to each other. It is preferred that the ladder include center hinging devices to join the two rung lengths at a rung center to hingeably collapse upwardly and to form a rigid structural support when lowered to a horizontal position. The preferred ladder includes a base support member separated into two parts, one part of a sufficient size and shape to receive a bottom of the left two quadrants of the tubular body and the other part to receive a bottom of the right two quadrants, the base support member further comprising a compressing means to allow sufficient resilient compression of the base support member when the bottoms of the tubular body are interfitted to the support member to hold the body wedged between a floor and a ceiling of an interior room. The base member is attached to the front quadrants and merely engages the rear quadrants. A preferred ladder includes a top support member separated into two parts, one part of a sufficient size and shape to attach to a top of the left rear quadrant and the other part to attach to a top of the right rear quadrant, the top support member further includes a hook device to hang the ladder proximate an escape opening out through a ceiling. A preferred ladder provides rung devices with a center hinging device locked along a vertical center joint between two rung members that span the distance between quadrants when the rung members are moved from a one to five degree angle upwardly from the horizontal alignment to a horizontal position.

A preferred interlocking device includes a pair of parallel grooves cut lengthwise into outside surfaces of the front and rear quadrants proximate to and on opposite sides of an abutting mating joint between the front and rear quadrants, wherein the direction of the depth of the grooves are angled toward each other. An extruded "U" shaped rigid member shaped to interfit into the grooves is provided of sufficient size to allow the "U" shaped member to slide along the length of the grooves. A slide attachment device is provided to rigidly attach the "U" shaped member to either the front quadrant or to the rear quadrant. Another preferred interlocking device includes dovetail joints between abutting mating joints between front and rear quadrants. It is preferred that those rung devices attached between the rear quadrants be limited to only those proximate an upper portion of the ladder.

FIG. 1 is a perspective view illustrating the use of ladder 20 to reach from floor 22 through ceiling 24 and out through skylight 26. Ladder 20 is constructed of four extruded aluminum members, right front side member 28, left front side member 30, right rear side member 32 and left rear side member 34. A preferred embodiment is where all of these member are identical extrusions. These members are all attached to each other and will be more fully described later. Ladder 20 rests upon a base support which is separated into two parts, right base support 40 and left base support 42. Base support 40 is attached to the bottom of right front side member 28 and left half base support 42 is attached to left front side member 30. When ladder 20 is not extended, rear side members 32 and 34 engage into base supports 40 and 42 respectively, but are not structurally attached to them. A top support for the ladder is provided, again into parts, right half top support 44 which is structurally attached to the top of right rear side member 32 and left half top support 46 which is structurally attached to left rear side member 34. In the extended position, the top supports do not engage the front side members 28 and 30. However, when the ladder is not extended, front right side member 28 and front left side member 30 engage into top supports 44 and 46 respectively but are not attached to them. Top supports 44 and 46 include hook shapes, pictured more clearly later, that engage into and are supported by brackets 48. These hooks of top supports 44 and 46 may also hook over and hang on outside frame 50 of the skylight when the skylight is openable from below. Handle 52 together with handle 56 hidden in this view, are attached on the opposite sides of ladder 20. Handle 52 is attached to left slide guide 54 which interlocks front left side member 30 with rear left side member 34 while allowing the two members to slide lengthwise relative to each other to extend the length of the ladder. Rung devices 36 attach to the inside and span the distance between front right side member 28 and left front side member 30 with a rung provided about each 12 inches. Rung devices 38 attached to the inside and span the distance between rear right side member 32 and left rear side member 34. In this embodiment, only four rung devices 38 are provided between the rear side members as it is sufficient to lengthen the ladder from about eight feet to about 12 feet which is normally sufficient for most room dimensions with a skylight.

Figure 2:
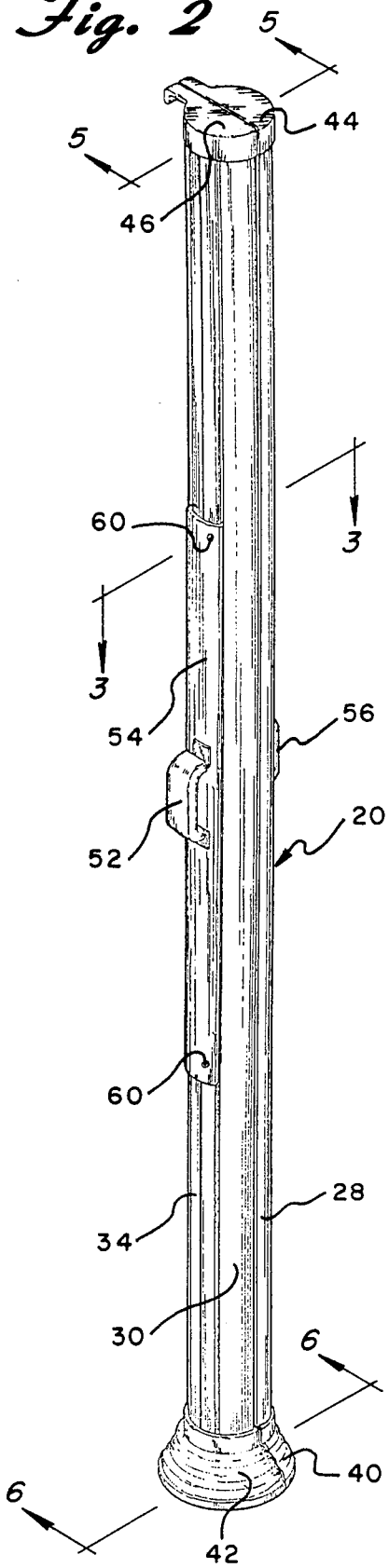
FIG. 2 is a perspective view of a ladder device of the present invention in the closed storage position.
Figure 3:
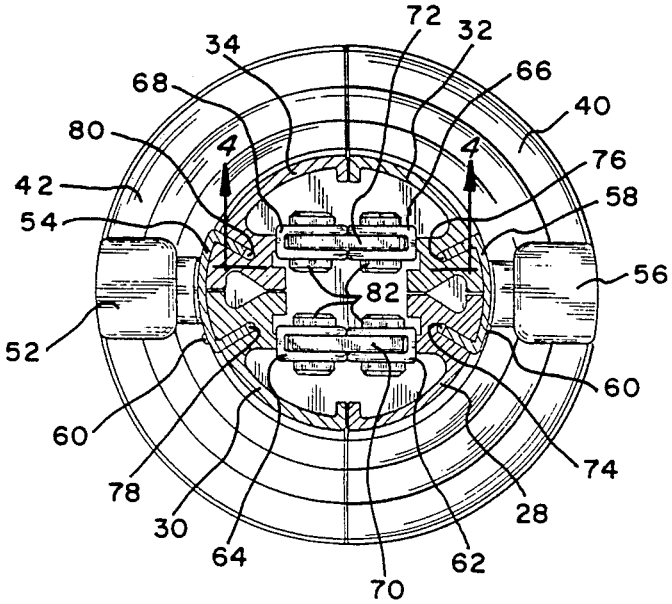
FIG. 3 is a horizontal cross-sectional view taken along lines 3—3 of FIG. 2.
Figure 4:
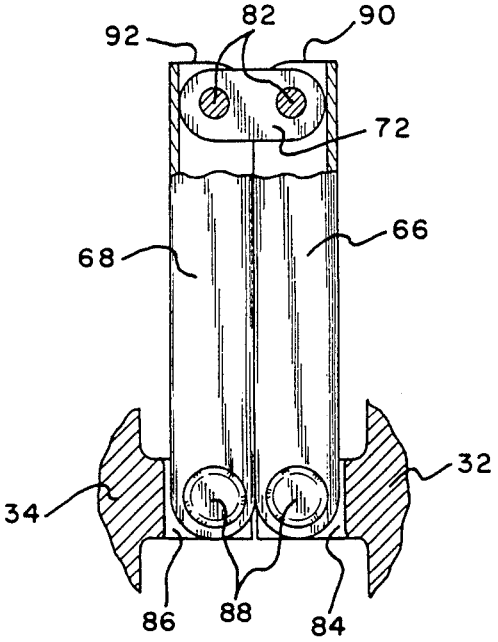
FIG. 4 is a partial cross-sectional view taken along lines 4—4 of FIG. 3.
Figure 5:
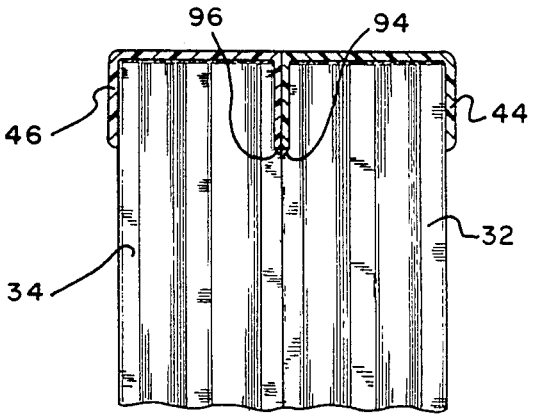
FIG. 5 is a partial cross-sectional view taken along lines 5—5 of FIG. 2.
Figure 6:
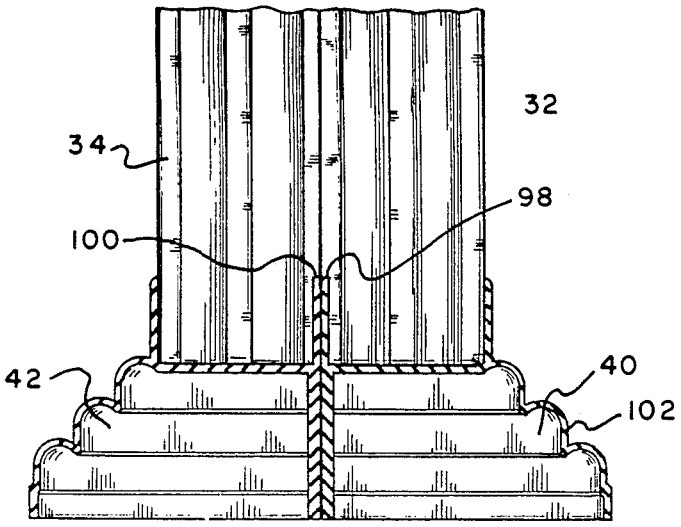
FIG. 6 is a partial cross-sectional view taken along lines 6—6 of FIG. 2.

In FIGS. 2 through 11, the same numerical designations are used for common parts illustrated in FIG. 1. FIG. 2 is a perspective view of ladder 20 in its collapsed form suitable for storage and in particular suitable to wedge between floor and ceiling to provide an unobtrusively or possibly decorative use. Although not illustrated, it is preferred that horizontal holes be provided into the housing into which can be threadably engaged or merely forced fitted rods suitable for handing towels or cloths on. These rods may pass all the way through the body and extend in both direction. In addition, these rods might serve a dual purpose to interlock the side members together after they are extended to a chosen length. In this view, all of the side members have now been pushed together to form a cylindrical shape. Base supports 40 and 42 are in abutment forming a compressible elastic support which will compress when wedged between ceiling and floor to hold the collapsed ladder 20 in position. Likewise, top supports 44 and 46 are not in abutment. Handles 52 and 56 are used to pull the ladder apart and push it together. Handle 52 is attached to left slide guide 54 which is an extruded shape generally having a cross-sectional shape of a "U" with the upright arms of the "U" angled slightly toward each other. Guide 54 interfits into grooves cut into left front side member 30 and left rear side member 34, the grooves being also angled inwardly so that the bottoms of the grooves are closer to each other than the tops of the grooves. The "U" shaped slide guide 54 is of a size and shape to slide easily along the grooves. Rivets 60 structurally fix slide guide 54 to front left side member 30 allowing rear left side member 34 to freely slide along the length of the joint between the two side members. On the other hand, the shape of slide guide 54 with the angle undercut of the grooves prevents disengagement of the two side members. In FIG. 3 which is a horizontal cross-sectional view looking downwardly the "U" shape of right slide guide 58 is shown interlocked into and holding right front side member 28 and rear right side member 32 together. Likewise, left slide guide 54 interlocks into and holds left front side member 30 and left rear side member 34 together. Right slide guide 58 interfits into right front groove 74 into right front side member 28 and into groove 76 cut into rear right side member 32. Likewise, left slide guide 54 interfits into left front groove 78 cut into left front side member 30 and into left rear groove 80 cut into left rear side member 34. In this view, the perspective is looking downwardly on the rung members folded upwardly and enclosed by the body composed of side members 28 through 34. In this view, right front rung member 62 and left front rung member 64 are held in a vertical position hingeably connected by front link 70 interconnected by rung rivets 82. Likewise, right rear rung member 66 and left rear rung member 68 are held vertically interconnected through rear link 72 by rung rivets 82. In the partial cross-sectional view of FIG. 3, taken vertically and partially cut out illustrates rungs 66 and 68 held in a vertical position while ladder 20 is in its storage position. Link member 72 attached through rivets 82 connects the center joint of rung members 66 and 68. At the outer ends of member 66 and 68, they are attached by rivets 88 to right vertical support 84 and left vertical support 86. Those vertical extensions being part of the extrusion of rear right side member 32 and left rear side member 34 respectively. Abutting surface 90 at the center of rung 66 and abutting surface 92 of rung 68 are of a rounded shape and position such that when rungs 66 and 68 are lowered to a horizontal position pivoting on linkage connection to link 72 and on supports 84 and 86 to a near horizontal position. As rung 66 and 68 are lowered to a horizontal position, abutting surfaces 90 and 92 contact each other while the rungs are still about one to five, preferably two to three, degrees away from horizontal. Further pressure downwardly causes rung 66 and 68 to lock together in a horizontal position placing the rungs in compression against rivets 82 and 88 and ultimately outwardly against side members 32 and 34. In FIG. 5, the top of ladder 20 in its storage position is shown with top support members 44 and 46 attached to rear side members 32 and 34. Top supports 44 and 46 are molded of structural plastic or of aluminum to provide structural strength to hang the ladder on. In order to provide as much structural integrity as possible, the top support members extend downwardly between abutting surfaces of the side members. Cut out 94 from side member 32 and cut out 96 from side member 34 allows the abutting surfaces of the side members to contact. In FIG. 6, the cross-sectional view illustrates base support members 40 and 42 into which is resting, but not attached, rear side members 32 and 34. Again, in order to allow material to surround the ends of the side members, cut out 98 from member 32 and cut out 100 from member 34 allow the abutting surfaces of the side members to touch. Base supports 40 and 42 are molded of a resilient soft rubber like material to allow compression and even suction against the floor. Accordingly shape 102 molded into the sides of base supports 40 and 42 facilitate compression of the material.

Figure 7:
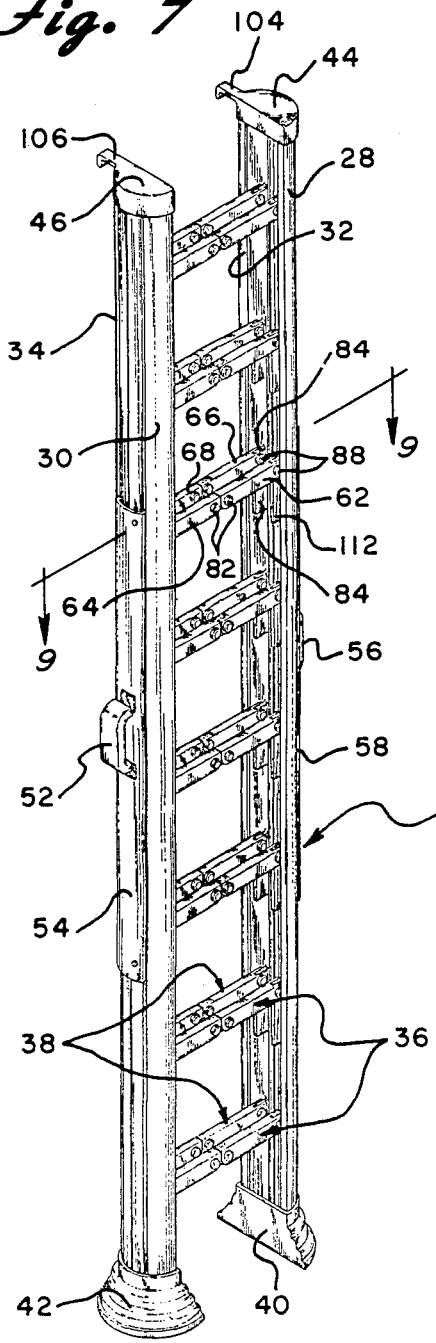
FIG. 7 is a perspective view of the ladder device illustrated in FIG. 2 pulled open to form the ladder structure.
Figure 8:
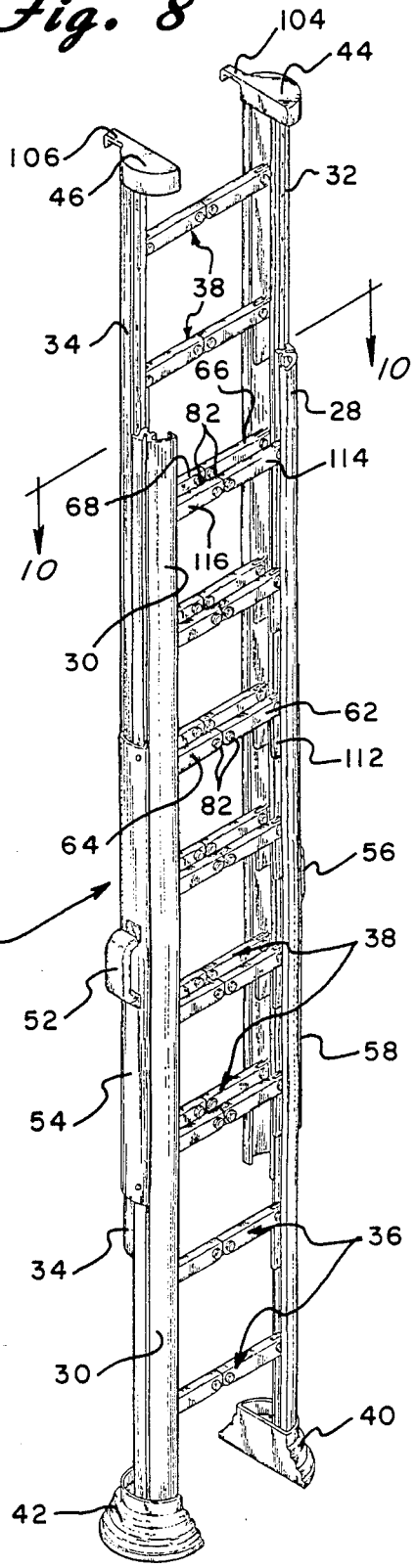
FIG. 8 is a perspective view of the ladder device illustrated in FIGS. 2 and 7 extended to added lengths.
Figure 9:
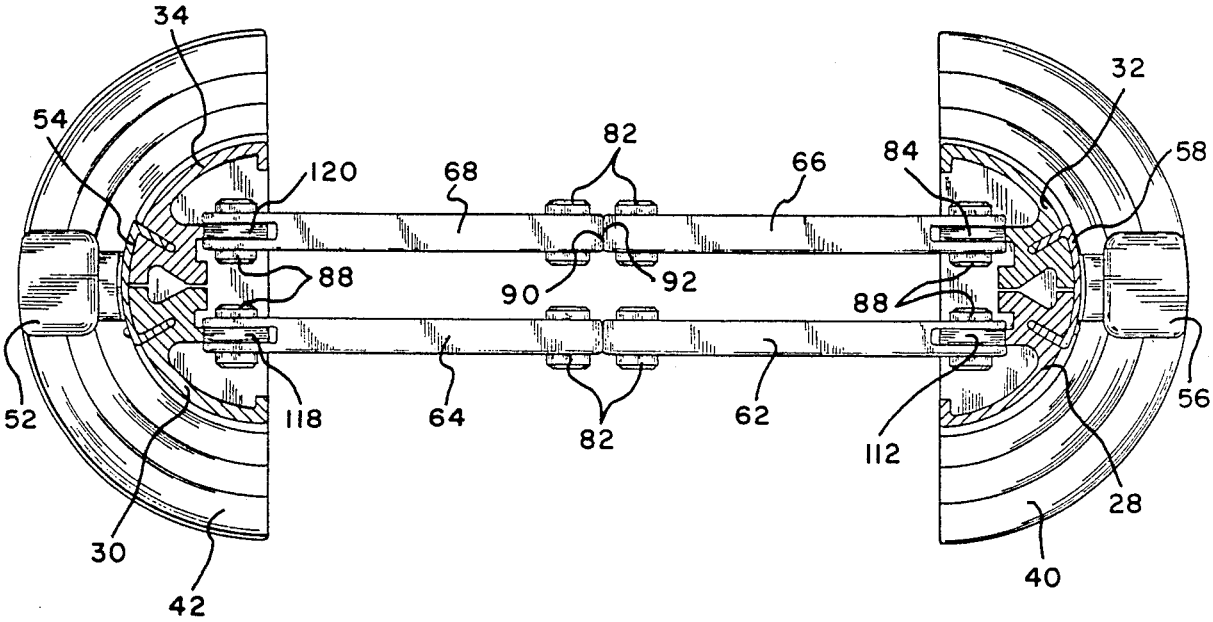
FIG. 9 is a horizontal cross-sectional view taken along lines 9—9 of FIG. 7.
Figure 10:
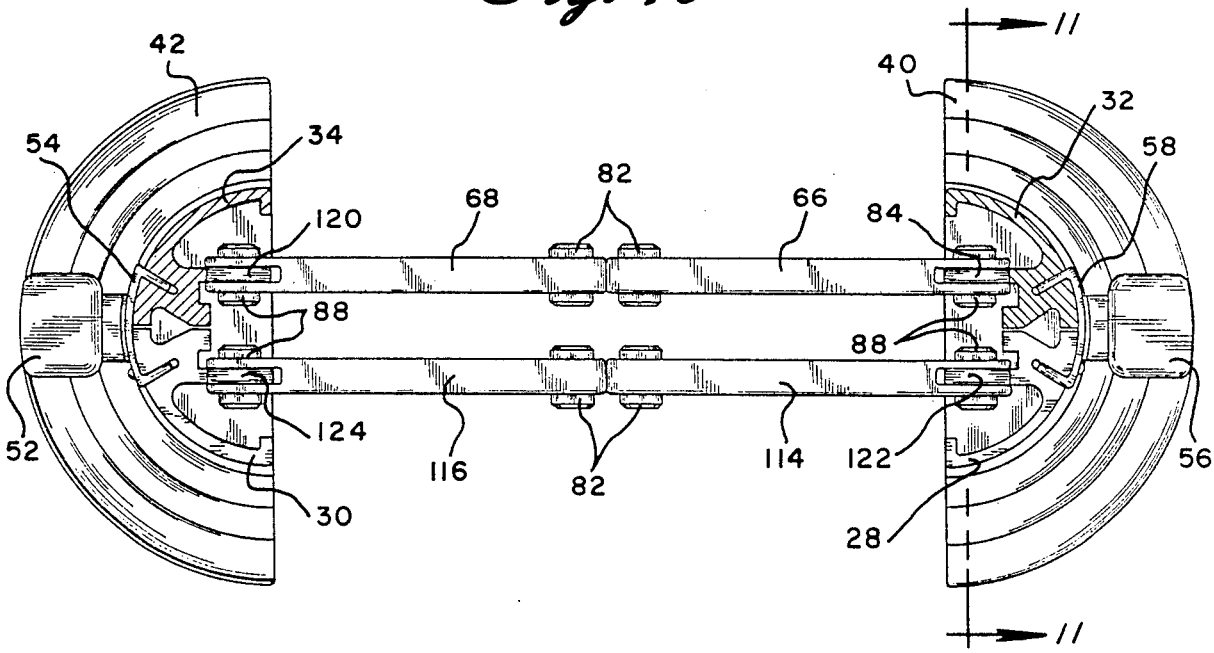
FIG. 10 is a horizontal cross-sectional view taken along lines 10—10 of FIG. 8.
Figure 11:
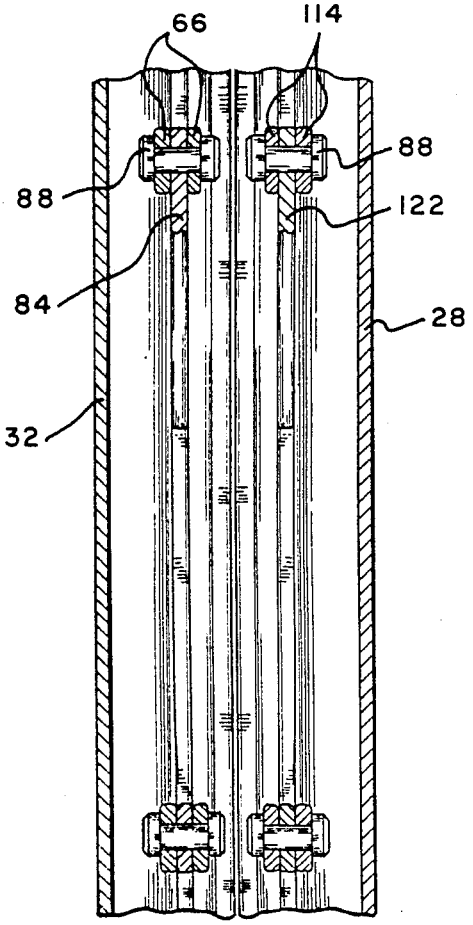
FIG. 11 is a partial cross-sectional view taken along lines 11—11 of FIG. 10.

In FIG. 7, a full length perspective view of ladder 20 is shown with the side member pulled apart to open the ladder and position front rungs 46 and rear rungs 38 in a horizontal position. This is accomplished by grasping handles 52 and 56 and pulling the side members apart. In this position, ladder 20 rests on base supports 40 and 42 with all side members either attached to engaged in the base support. Likewise, top supports 44 and 46 are not separated and structurally attached to rear side members 32 and 34 while being engaged on top of front side members 28 and 30. In this embodiment, there are front rung devices 36 at one foot intervals as well as rear rung devices 38 at one foot intervals attached to the rear side members. However, as illustrated in FIG. 1, it is typically not necessary that rear rung devices be included at the lower end of ladder 20. It is not necessary to have a double rung structure at all heights and in any case, as illustrated in FIG. 8, when the ladder is lengthened, the lower rungs and the upper most rungs must of necessity of single rung structure. In FIG. 7, right rung member 62 and left front rung member 64 are not in a horizontal position locked into position in compression against rivets 82 and 88. Likewise, right rear rung member 66 and left rear rung member 68 are locked into a horizontal position. As illustrated earlier, right rear rung member 66 is pivotally connected to vertical support 84 and in this view, connection of right front rung member 62 is pivotally attached through rivet 88 to vertical support member 112. In this configuration, hooks 104 and 106 hooking downwardly and as an integral part of the molding of top support members 44 and 46 respectfully, are designed to hook over a skylight frame or onto a horizontal support member attached to the wall. In FIG. 8, ladder 20 has been lengthened by sliding left side members 32 and 34 upwardly sliding in slide members 54 and 56 to attach hooks 104 and 106 proximate a skylight. Upper rung devices 38 are not single rungs and the rung device composed of rung member 66 and 68 have now been moved up two places so that they are now at a height equal to that of rung members 114 and 116. In this configuration, ladder 20 may be hung from above allowing the bottom of the ladder to rest on the rubber like base supports 40 and 42 which are slippage resistant and tend to grab the floor as they are tilted. In FIG. 9, a cross-sectional view is provided looking downwardly at about the same height as illustrated in FIG. 3. In this view, however, the ladder side members have been pulled apart to bring the rung devices into a locked horizontal position right rear rung member 66 and left rear rung member 68 are held together in the center by the linkage and rivets 82 to lock opposing vertical surfaces 90 and 92 in compression. The outer end of rung member 66 is attached through rivet 88 to vertical support member 84 providing compression against rear right side member 32. Likewise, left rear rung member 68 is attached at its outside end through rivet 88 to vertical support member 120. Front rung member 62 and 64 are likewise placed in compression in a horizontal position and attached to vertical support members 112 and 118 respectively to right front side member 28 and left front side member 30 respectively. In FIG. 10, with ladder 20 partially lengthened, the cross-sectional view is above the upper ends of front side members 28 and 30. The rung devices of rung members 66 and 68 has now been moved upwardly to be at the same height as the rung device of rung members 114 and 116 attached to front side members 28 and 30 which are connected at their ends to vertical support members 122 and 124 extending from front side members 28 and 30 respectively. In the vertical cross-sectional view of FIG. 11, rear rung member 66 is shown pivotally attached through rivet 88 to vertical support member 84 and rung member 114 is attached through rivet 88 to vertical support member 122.

Figure 12:
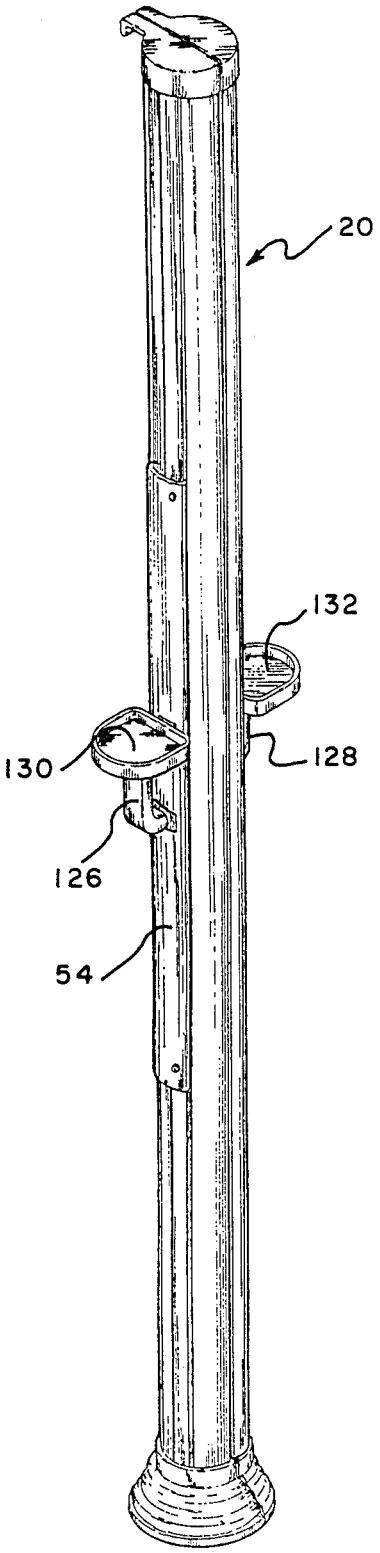
FIG. 12 is another embodiment of the ladder device of the present invention illustrating multiple purpose handles.

FIG. 12 is a modified embodiment wherein handles 126 and 128 are attached to slide members 54 and 58 (hidden). Handles 126 and 128 also include shelves 130 and 132 to hold nick knacks, flower pots, soap or the like. In this configuration, the ladder is supported between floor and ceiling while not in use.

Figure 13:
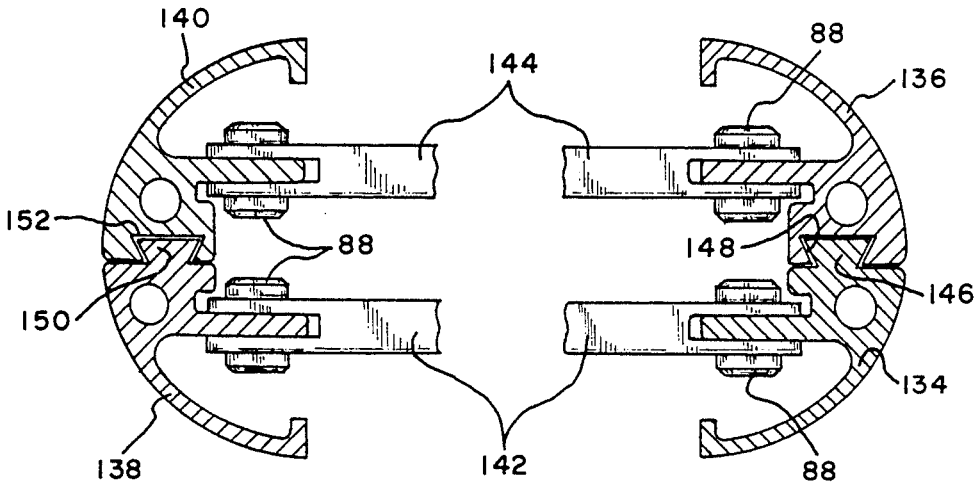
FIG. 13 is a cross-sectional view similar to that of FIG. 9 except it is of another embodiment of the present invention.

The cross-sectional view in FIG. 13 is a view similar to that illustrated in FIG. 9 except that in this embodiment, the front and rear side members are slideably attached in a different fashion. In this embodiment, front right side member 134 has at its opposing surface with rear right side member 36 a positive dovetail extension 146 which interfits into dovetail groove 148 cut out of right rear side member 136. Likewise, left front side member 138 has positive dovetail shape extension 150 extending toward the adjacent surface of left rear side member 140 which is equipped with dovetail groove 152. The dovetail connections are designed to allow easy sliding of the members along their length but eliminates the possibility of disattachment. Rung devices 142 and 146 are attached to the front side members and rear side members respectively using rivets 88.

Figure 14:
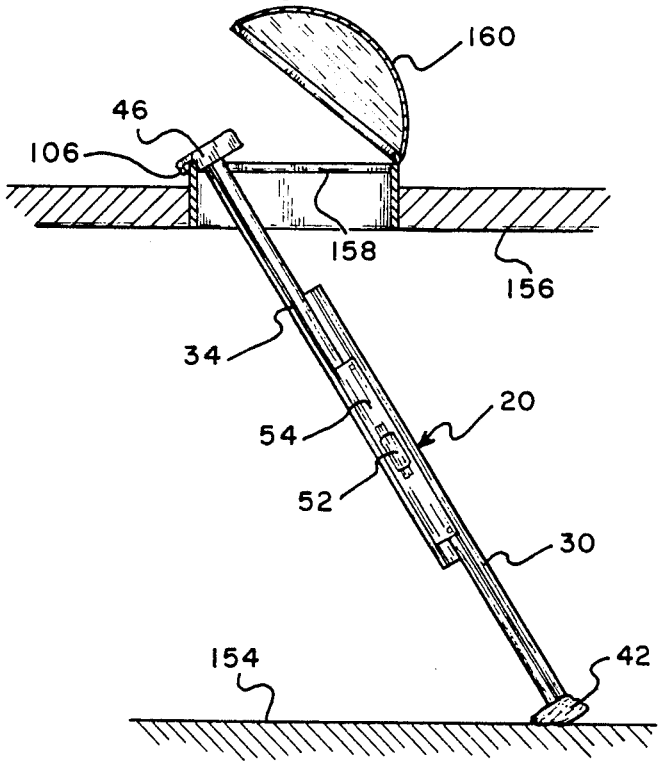
FIG. 14 is a diagram illustrating the use of the present invention with a horizontal skylight opening out of a ceiling to a flat roof.

FIG. 14 is a diagram illustrating the use of ladder 20 in a room with floor 154 and ceiling 156 through which opening 158 is cut to house skylight 160 which is shown pivoting upwardly to open as an escape door. Ladder 20 with left rear side member extended upwardly hooks through top support member 46 and hook 106 over frame edge 108. Ladder 20 with front side member 30 resting on the ground on base support 42 does not slide and provides a stable support for climbing. When ladder 20 is lifted and hooked over frame 158, the ladder is allowed to lengthen downwardly to a suitable angle and wedges against the floor as weight is applied to the ladder.

While this invention has been described with reference to the specific embodiments disclosed herein, it is not confined to the details set forth and the patent is intended to include modifications and changes which may come within and extend from the following claims.

We claim:

1. A ladder comprising:

(a) an elongated tubular housing divided lengthwise into two separate mated ladder side members, each ladder side member being separated lengthwise into a front side member and a rear side member, (b) slide means to lengthwise abut and interlock each front side member with the adjacent rear side member while allowing them to slide lengthwise relative to each other to extend the length of the ladder, (c) a plurality of rung means comprising two separate parallel rungs, one rung hineably attached to the front side members and one rung hingeably attached to the rear side members, each rung means further comprising a rung separated into two rung members which together span a distance between the ladder side members when the side members are separated, (d) center hinging means to joint he two rung lengths at a rung center to hingeably collapse upwardly and to form a rigid structural support when lowered to a horizontal position, (e) end hinging means to connect the ends of each rung to opposite ladder side members in a horizontal position and to allow the rung lengths to hingeably collapse upwardly to a vertical position when the ladder side members are mated together, and wherein the tubular housing is of sufficient the size and shape to enclose the hingeably collapsed rungs when the ladder side members are mated together.

2. The ladder of claim 1 wherein rung means are attached between the rear side members only proximate an upper portion of the ladder.

3. The ladder of claim 1 further comprising a base support member separated into two parts, one part of a sufficient size and shape to receive a bottom of one ladder side member and the other part to receive the other ladder side member bottom, the base support member further comprising a compressing means to allow sufficient resilient compression of the support member when the bottoms of the ladder side members are interfitted to the support member to hold the housing wedged between the floor and the ceiling.

4. The ladder of claim 3 wherein each part of the base member is attached to the front side member and merely engages the rear side member.

5. The ladder of claim 1 further comprising a top support member separated into two parts, one part of a sufficient size and shape to attach to a top of one ladder side member and the other part to attach to the other ladder side member top, the top support member further comprising a hook means to hang the ladder to a ceiling mounting means attached proximate an escape opening out through the ceiling.

6. The ladder of claim 5 wherein each part of the top support member is attached to the rear side member and merely engages the front side member.

7. The ladder of claim 1 wherein the slide means comprises:

(a) a pair of parallel grooves cut lengthwise into outside surfaces of the front and rear side members proximate to and on opposite sides of an abutting mating joint between the front and rear side members, wherein the direction of the depth of the grooves are angled toward each other.

(b) an extruded "U" shaped rigid member shaped to interfit into the grooves of sufficient size to allow the "U" shaped member to slide along the length of the grooves and (c) slide attachment means to rigidly attach the "U" shaped member to either the front side member or to the rear side member.

8. The ladder of claim 1 wherein the slide means comprises a dovetail joint between an abutting mating joint between front and rear side members.

9. The ladder of claim 8 further comprising handles attached to opposite "U" shaped members to allow easy opening and closing of the ladder.

10. The ladder of claim 9 wherein the handles are structured to serve a separate function of holding objects when the tubular housing is closed with rungs folded away.

11. The ladder of claim 1 wherein the two rung members of the rung means are of equal length.

12. The ladder of claim 1 wherein the center hinging means lock along a vertical center joint as the rung lengths are moved from a one to five degree angle upwardly from the horizontal to a horizontal alignment.

13. The ladder of claim 1 further comprising a top support member separated into two parts, one part of a sufficient size and shape to attach to a top of one ladder side member and the other part to attach to the other ladder side member top, the top support member further comprising a hook means to hang the ladder proximate an escape opening out through the ceiling.

14. The ladder of claim 1 wherein the two ladder side members are extruded and when mated together form a cylindrical shape.

15. An escape ladder comprising:

(a) an elongated tubular housing comprising:

(i) a length having a top and a bottom to interfit between ceiling and floor of interior rooms, (ii) mated halves juxtaposed along lengthwise joints that form ladder side members when separated from each other, (b) a plurality of jointed rung members that hingeably attach at their ends to opposite ladder side members and hingeably fold upwardly when the ladder side members are mated together, (c) elongation means to allow the ladder side members to elongate comprising:
(i) each ladder side member being separated lengthwise into a front side member and a rear side member, and
(ii) slide means to lengthwise abut and interlock each front side member with the adjacent rear side member while allowing them to slide lengthwise relative to each other to extend the length of the ladder, and
(d) hanging means to hang the top the ladder side members proximate an escape opening out through the ceiling.

16. The ladder of claim 15 further comprising center hinging means to join the jointed rung members at a rung center to hingeably collapse upwardly and to form a rigid structural support when lowered to a horizontal position.

17. The ladder of claim 15 wherein the tubular housing is of sufficient the size and shape to enclose the hingeably collapsed rungs when the ladder side members are mated together.

18. The ladder of claim 15 wherein the slide means comprises:
(a) a pair of parallel grooves cut lengthwise into outside surfaces of the front and rear side members proximate to and on opposite sides of an abutting mating joint between the front and rear side members, wherein the direction of the depth of the grooves are angled toward each other,

19. The ladder of claim 15 wherein the slide means comprises a dovetail joint between an abutting mating joint between front and rear side members.

20. The ladder of claim 15 further comprising a top support member separated into two parts, one part of a sufficient size and shape to attach to a top of one ladder side member and the other part to attach to the other ladder side member top, the top support member further comprising a hook means to hang the ladder to a ceiling mounting means attached proximate an escape opening out through the ceiling.

21. A method to provide escape from an upstairs room with a ceiling escape aperture of sufficien size and shape to allow a person to escape out through the aperture, the method comprising:
(a) placing a ladder with a top and a bottom, the ladder being capable of collapsing horizontally into a tubular shape to interfit vertically between the ceiling and a floor of the room,
(b) removing the ladder from between the ceiling and the floor,
(c) pulling the ladder side members apart to cause rung members of the ladder to drop and lock in a horizontal position,
(d) extending the ladder a sufficient length to reach a height proximate the aperture when the ladder is placed at an angle suitable for climbing, and
(e) hanging the top of the ladder of the ladder proximate the aperture with bottom of the ladder resting on the floor.

22. The method of claim 21 further comprising hingeably collapsing center hinging means joining jointed rung members at a rung center to collapse the rung members upwardly and be enclosed inside the tubular shape.

23. The method of claim 21 wherein extending the ladder further comprises siding separated side members, the side members being separated lengthwise into a front side member and a rear side member, interlock between each other allowing them to slide lengthwise relative to each other to extend the length of the ladder.

24. A ladder comprising:
(a) an elongated tubular body divided lengthwise such that a lateral cross-section of the body is divided into four quadrants, the quadrants being front quadrants, right and left, and rear quadrants, right and left,
(b) a plurality of rung means hingeably attached between rear quadrants and between front quadrants to provide support in a horizontal position and fold upwardly for storage inside the tubular body when the left and right quadrants are mated together, and
(c) interlocking means to interlock right quadrants together and left quadrants together to allow the interlocked pairs to slideably move only lengthwise in relation to each other.

25. The ladder of claim 24 further comprising center hinging means to joint the two rung lengths at a rung center to hingeably collapse upwardly and to form a rigid structural support when lowered to a horizontal position.

26. The ladder of claim 24 further comprising a base support member separated into two parts, one part of a sufficient size and shape to receive a bottom of the left two quadrants of the tubular body and the other part to receive a bottom of the right two quadrants, the base support member further comprising a compressing means to allow sufficient resilient compression of the base support member when the bottoms of the tubular body are interfitted to the support member to hold the body wedged between a floor and a ceiling of an interior room.

27. The ladder of claim 26 wherein each part of the base member is attached to the front quadrants and merely engages the rear quadrants.

28. The ladder of claim 24 further comprising a top support member separated into two parts, one part of a sufficient size and shape to attach to a top of the left rear quadrant and the other part to attach to a top of the right rear quadrant, the top support member further comprising a hook means to hang the ladder proximate an escape opening out through a ceiling.

29. The ladder of claim 24 wherein the rung means comprise a center hinging means locked along a vertical center joint between two rung members that span the distance between quadrants when the rung members are moved from a one to five degree angle upwardly from the horizontal to a horizontal alignment.

30. The ladder of claim 24 wherein wherein the interlocking means comprises:
(a) a pair of parallel grooves cut lengthwise into outside surfaces of the front and rear quadrants proximate to and on opposite sides of an abutting mating joint between the front and rear quadrants, wherein the direction of the depth of the grooves are angled toward each other,
(b) an extruded "U" shaped rigid member shaped to interfit into the grooves of sufficient size to allow the "U" shaped member to slide along the length of the grooves, and
(c) slide attachment means to rigidly attach the "U" shaped member to either the front quadrant or to the rear quadrant.

31. The ladder of claim 24 wherein the interlocking means comprises a dovetail joints between abutting mating joints between front and rear quadrants.

32. The ladder of claim 24 rung means are attached between the rear quadrants only proximate an upper portion of the ladder.

33. A ladder comprising:

(a) an elongated tubular housing divided lengthwise into two separate mated ladder side members, (b) a plurality of rung means, each means comprising a rung separated into two rung members which together span a distance between the ladder side members when the side members are separated, (c) center hinging means to join the two rung lengths at a rung center to hingeably collapse upwardly and to force a rigid structural support when lowered to a horizontal position, (d) end hinging means to connect the ends of each rung to opposite ladder side members in a horizontal position and to allow the rung lengths to hingeably collapse upwardly to a vertical position when the ladder side members are mated together, and (e) a base support member separated into two parts, one part of a sufficient size and shape to receive a bottom of one ladder side member and the other part to receive the other ladder side member bottom, the base support member further comprising a compressing means to allow sufficient resilient compression of the support member when the bottoms of the ladder side members are interfitted to the support member to hold the housing wedged between a floor and a ceiling of a room, wherein the tubular housing is of sufficient the size and shape to enclose the hingeably collapsed rungs when the ladder side members are mated together.

34. The ladder of claim 14 wherein the compressing means comprises a soft resilient polymeric composition.

35. An escape ladder comprising:

(a) an elongated tubular housing comprising:

(i) a length having a top and a bottom to interfit between ceiling and floor of interior rooms, (ii) mated halves juxtaposed along lengthwise joints that form ladder side members when separated from each other, (b) a plurality of jointed rung members that hingeably attach at their ends to opposite ladder side members and hingeably fold upwardly when the ladder side members are mated together, (c) elongation means to allow the ladder side members to elongate, (d) hanging means to hang the top the ladder side members proximate an escape opening out through the ceiling, and (e) a base support member separated into two parts, one part of a sufficient size and shape to receive a bottom of one ladder side member and the other part to receive the other ladder side member bottom, the base support member further comprising a compressing means to allow sufficient resilient compression of the support member when the bottoms of the ladder side members are interfitted to the support member to hold the housing wedged between the floor and the ceiling.

* * * * *